United States Patent [19]

Hasegawa et al.

[11] 4,350,741

[45] Sep. 21, 1982

[54] RESISTOR ELEMENTS

[75] Inventors: Yo Hasegawa, Nara; Shigeru Yasuda, Hirakata; Kunio Kojima, Neyagawa, all of Japan

[73] Assignee: Matsushita Electric Industrial Co., Ltd., Japan

[21] Appl. No.: 207,069

[22] Filed: Nov. 14, 1980

[30] Foreign Application Priority Data

Nov. 19, 1979 [JP] Japan ..... 54-150410

[51] Int. Cl.[3] ..... H01C 1/012; H01C 10/06

[52] U.S. Cl. ..... 428/473.5; 264/132; 264/134; 264/272.18; 264/105; 428/698; 338/307; 338/308

[58] Field of Search ..... 264/105, 132, 134, 272.18; 338/307, 308, 309; 252/511, 518; 428/473.5, 698

[56] References Cited

U.S. PATENT DOCUMENTS 3,037,266 6/1962 Pfister ..... 264/105 X
4,119,937 10/1978 Melvin ..... 338/308

FOREIGN PATENT DOCUMENTS 55-9441 1/1980 Japan ..... 264/272.18
1002048 8/1965 United Kingdom ..... 338/308

*Primary Examiner*—Thomas P. Pavelko
*Attorney, Agent, or Firm*—Wenderoth, Lind & Ponack

[57] ABSTRACT

Resistor elements made by co-molding of film-resistors comprising conductive powder and polyimide resin and a diallyl isophthalate substrate containing more than 500 ppm inhibitors have good thermal stability and smooth surfaces, and are especially suitable for long life potentiometers for high temperature uses.

6 Claims, 6 Drawing Figures

RESISTOR ELEMENTS

BACKGROUND OF THE INVENTION

This invention relates to novel resistor elements which have good high temperature stability and long life as potentiometer resistor elements. Here, "good high temperature stability" means small change in electrical resistivity when the resistor elements are stored at high temperature. And, "long life" also means small change in electrical resistivity when the resistor elements are used in potentiometers.

Composition film resistors comprising resistor films and insulating substrates are widely used as fixed or variable resistors. And, for long life potentiometers, so-called conductive plastics wherein the resistor films 1 and insulating substrates 2 are molded together as shown in FIG. 1 are used.

In conductive plastics, phenolic resins, xylene resins, or diallyl phthalate resins were used as binders of resistor films and substrates. Although these resins are satisfactory for conventional uses, they are not satisfactory for special purposes such as automotive electronics where high temperature stability and long life is expected.

For the purpose of only improving thermal stability, the combination of ceramics or polyimide substrates and resistor films using aromatic polyimide resin as binders suffices. But, in this case, revolution life is a maximum $5\times16^6$ revolutions, and that is insufficient for long life potentiometers.

An object of this invention is, therefore, to provide novel thermally stable and long life resistor elements for potentiometers.

BRIEF SUMMARY OF THE INVENTION

This objective is accomplished by using the following combination of resistor film and substrate composition. Resistor elements of this invention are made by coating a substrate (which comprises diallyl isophthalate prepolymer, radical initiators, mineral fillers and inhibitors, where the amount of inhibitors is more than 500 ppm with respect to the prepolymer) with resistor ink which comprises conductive powder, aromatic polyamic acid solution and solvent, followed by drying and compression molding.

DETAILED DESCRIPTION

Diallyl isophtalate monomer can be added to the substrate to control the curing rate and flow characteristics. The aromatic polyimide of this invention has mainly the following structural formula. It can be obtained partly modified to increase its adhesive characteristics etc. It is available under the trade name of "Pyre-ML" (E. I. DuPont et. Nemours & Co.), "Torayneece" (Toray Co.) and so on.

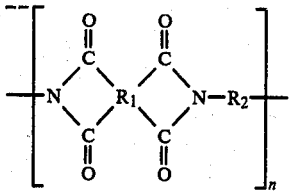

Where, $R_1$ is a aromatic hydrocarbon and $R_2$ is a aromatic residue of aromatic diamine.

Diallyl isophthalate prepolymer can be obtained under the tradename of "Diaso DAP 100L" (Osaka Soda Co.), "DAPON M" (Sumitomo Chemical Co.) etc.

As inhibitors, well known radical inhibitors can be used, such as, hydroquinone, phenol, catechol, pyrogallol and their derivatives, p-benzoquinone, chloranil, D.P.P.H. etc. The amount of inhibitor should be more than 500 ppm, preferably more than 1000 ppm based on the amount of diallyl isophthalate prepolymer. If the amount of inhibitors is less than 500 ppm, smooth surface resistor film cannot be produced, even though the surface of the mold is finished very smooth. By using 1000 ppm inhibitors, very smooth surface resistor film can be obtained. Even though the amount of inhibitors is more than 1000 ppm, smooth surface resistor film can be produced by controlling the amount of initiators.

As initiators, conventional radical initiators can be used, like a conventional diallyl phthalate molding compound, di-cumyl peroxide or p-tertbutylperoxy peroxy benzoate—the most preferable. The amount of initiator is 0.5–5 phr, the same amount as in a conventional diallyl phthalate molding compound.

Figure 1:
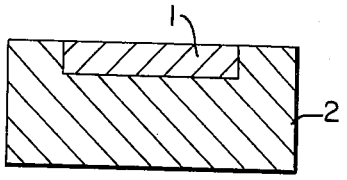
FIG. 1 is a side view of a typical film resistor.
Figure 2:
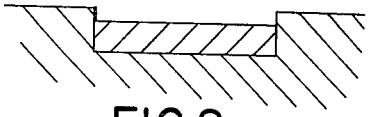
FIG. 2 is a side view of a film resistor segment exhibiting a difference in level between the substrate and the resistor film.

The surface of resistor film produced from the above-mentioned composition and process is very smooth and will work well for long life potentiometers of slow rotation rates. But, a very small difference in level occurs between the surface of the resistor film and that of the substrate as shown in FIG. 2. This difference in level makes it difficult to use the resistor element in high rotation rate potentiometers. For the purpose of reducing this difference in level, the addition of boron nitride powder having a hexagonal structure system is effective. By adding boron nitride powder to resistor film composition, difference in level can be reduced and the resistor elements thus obtained can be used in high rotation rate potentiometers.

The amount of boron nitride powder in the resistor film is preferably 20–55 weight percent. Less than 20% addition of boron nitride powder is insufficient to reduce the difference in level, and more than 55% results in wear of resistor film. Another benefit of boron nitride powder addition is that the addition reduces internal stress in the resistor film. Internal stress sometimes causes cracks or curls in resistor film, and these problems can be avoided by the addition of boron nitride powder.

This invention will be further illustrated by the following examples and comparative examples, although, it must be understood that these examples are included merely for purposes of illustration and are not intended to limit the scope of the invention.

EXAMPLE 1

(a) Resistor Ink 50.0 g of aromatic polyimide prepolymer solution (Pyre-ML:RC-5057) was mixed with 4.2 g of carbon black (1:1 mixture of acetylene black and lamp black) and was milled by a three-roll mill to yield resistor ink.

(b) Substrate Powder 25.0 g of diallyl phthalate prepolymer (Daiso DAP 100L), 75.0 g of silica powder, 0.25 g of dicumyl peroxide, 25 mg (1000 ppm) of hydroquinone, 0.15 g of cyanine green and 20.0 g of acetone were mixed and milled by hot two-roll mill at 100° C. to yield a 0.5 mm thick sheet. This sheet was then crushed and sieved to yield a powder substrate.

(c) Resistor Element

The powder substrate was compression molded at room temperature at the pressure of 5 tons/cm$^2$ to yield a substrate for the resistor element. Resistor ink was then screen printed onto the substrate followed by 30 minutes drying at 140° C. The printed substrate was then put into a mold whose surface was finished smooth, and compression molded 1 minute at 180° C. at the pressure of 350 kg/cm$^2$ to form a resistor element, followed by 3 hours after curing at 220° C.

Figure 3:
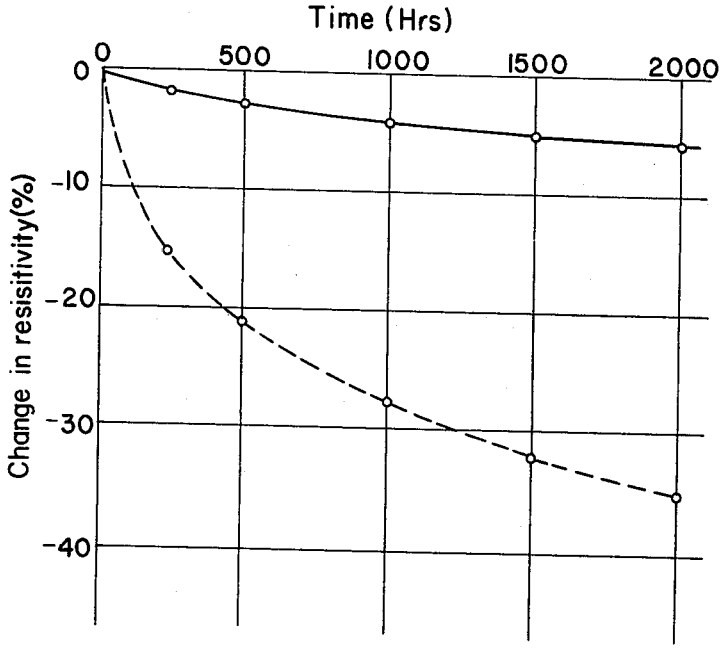
FIG. 3 is a plot of change in resistivity with respect to time for a resistor film of the present invention and a film of the prior art.

The resistor element of this example has a very smooth resistor film surface, and the change in electrical resistivity is shown in FIG. 3 by solid line when it is stored at 150° C. For an understanding of this invention, the change in resistivity at 150° C. of a conventional resistor element, where diallyl isophthalate resin is used as the binder of resistor film, is also shown in FIG. 3 by dotted line. From FIG. 3 one can see that the resistor element of this invention is extremely superior to the conventional one.

A revolution life test was performed, and resistor element of this example showed only −2.5% change in resistivity after $2\times10^7$ revolutions.

[COMPARATIVE EXAMPLE]

A resistor element was made in the same manner as in Example 1 except that the amount of hydroquinone was 5 mg (200 ppm) and that drying of resistor ink was 30 minutes at 85° C. A 140° C. drying of resistor ink was impossible because substrate cures at 140° C. This resistor element has small creases on the resistor film surface, and shows an 8.5% change in resistivity even after $5\times10^6$ revolutions. Thermal characteristics of this resistor element were the same as in Example 1.

EXAMPLE 2

A resistor element was made in the same manner as in Example 1 except that the amount of hydroquinone was 12.5 mg (500 ppm) and that drying was 30 minutes at 120° C. The surface of the resistor film was smooth but a little hazy. This resistor element has the same thermal characteristics as Example 1, and shows 5.5% change in resistivity after $2\times10^7$ revolutions.

EXAMPLE 3

A resistor element was made in the same manner as in Example 1 except that the recipe of resistor ink was as follows.

| | |
|---|---|
| Pyre ML (RC 5057) | 50.0 g |
| Carbon black | 4.2 g |
| Boron nitride Powder* | 4.15 g** |
| Benzyl alcohol | 7.0 g |

*Denki Kagaku Kogyo Co. "HGP-4S"
**This amount is 25% of the solid content of resistor ink.

The resistor element of this example shows practically no difference in level between resistor film surface and substrate surface, and the surface of resistor film was very smooth and showed only 1.5% change in resistivity after $2\times10^7$ revolution. Thermal characteristics of this resistor element were the same as in Example 1.

EXAMPLE 4

A resistor element was made in the same manner as in Example 3 except that the amount of boron nitride powder was 15.0 g (54.6% in solid content of resistor ink). This resistor element had a very smooth but lusterless resistor film surface. Thermal characteristics of this resistor element were a little superior to that of Example 3. The change in resistivity after $2\times10^7$ revolutions was 12.4%.

EXAMPLE 5

A resistor element was made in the same manner as in Example 3 except that the amount of boron nitride powder was 3.1 g (19.9% in solid content of resistor ink). Thermal and revolutional characteristics were close to those of Example 3, and there was a very slight difference in level between resistor film surface and substrate surface, but the difference seems too small to cause any practical problem.

EXAMPLE 6

A resistor element was made in the same manner as in Example 1 except that the composition of resistor ink was as follows.

| | |
|---|---|
| Torayneece 2000 | 50.0 g |
| Carbon black | 5.6 g |
| Boron nitride powder | 5.6 g |
| Benzyl alcohol | 7.0 g |

Figure 4:
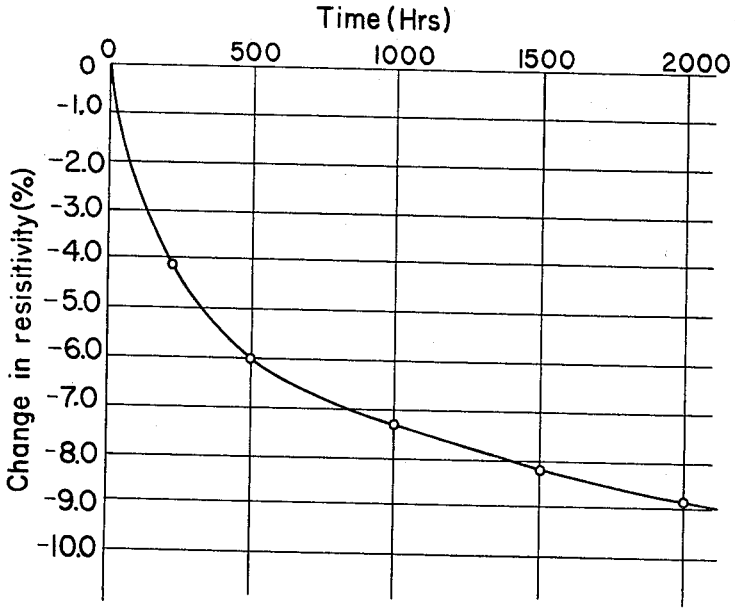
FIGS. 4 to 6 are plots of change in resistivity with respect to time for embodiments of the present invention.

Thermal characteristics of this example are shown in FIG. 4. The revolutional characteristics of this example were the same as those of Example 3.

EXAMPLE 7

Figure 5:
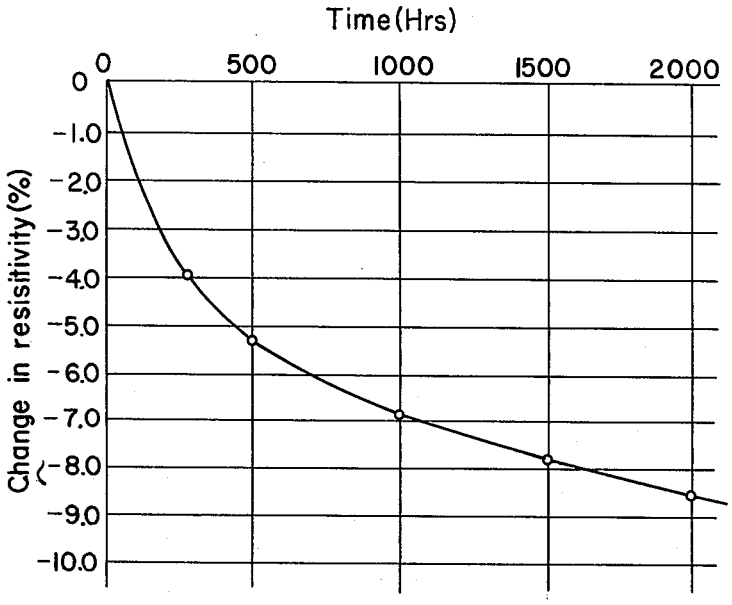

A resistor element was made in the same manner as in Example 6 except that "DAPON M" was used as binder of the substrate. Thermal characteristics of this example are shown in FIG. 5. The revolutional characteristics of this example were the same as those of Example 3.

EXAMPLE 8

A resistor element was made in the same manner as in Example 7 except that the recipe for resistor ink was as follows

| | |
|---|---|
| Aromatic polyamic acid solution* | 50.0 g |
| Carbon black | 8.0 g |
| Boron nitride powder | 6.3 g |
| Benzyl alcohol | 6.0 g |

*The 25% solution of polyamic acid for the polyimide after baking had the following formula. Supplied by UBE Industries Co.

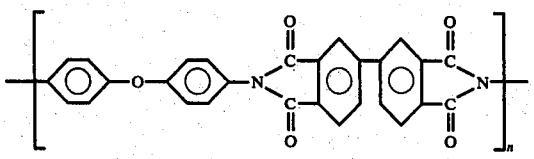

Figure 6:
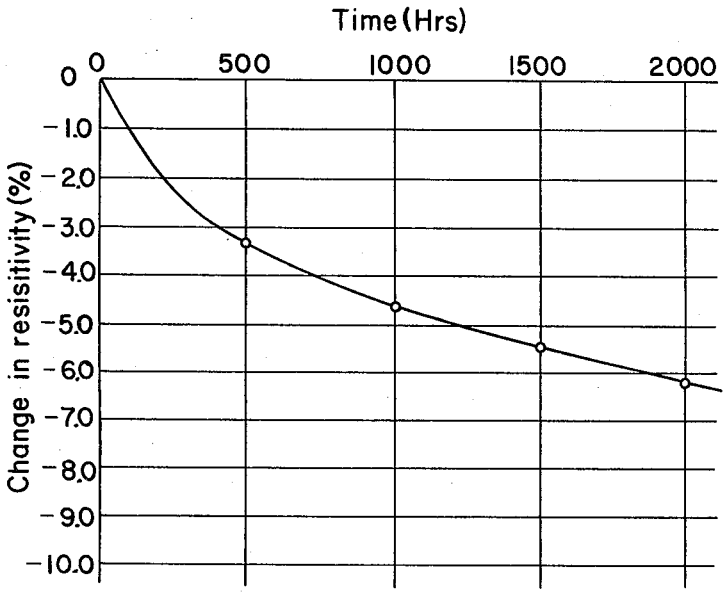

Thermal characteristics of this Example are shown in FIG. 6.

What we claim is:

1. A method of producing a resistor element which comprises molding a resistor film comprising aromatic polyimide and conductive powder together with a substrate comprising diallyl isophthalate prepolymer, polymerization initiators, inorganic fillers and radical polymerization inhibitors wherein the amount of inhibitors is more than 500 ppm based on the prepolymer.

2. A method of producing a resistor element which comprises molding a resistor film comprising aromatic polyimide, conductive powder and boron nitride powder having the hexagonal system together with a substrate comprising diallyl isophthalate prepolymer, polymerization initiators, inorganic fillers and radical polymerization inhibitors wherein the amount of inhibitors is more than 500 ppm based on the prepolymer.

3. The method of claim 2 where content of said boron nitride powder is 20–55 weight percent of resistor film.

4. The resistor element produced by the process of claim 1.

5. The resistor element produced by the process of claim 2.

6. The resistor element produced by the process of claim 3.

* * * * *